United States Patent [19]

Missale et al.

[11] 4,147,281

[45] Apr. 3, 1979

[54] TOY SODA JET DISPENSER WITH MOVING DISPLAY

[76] Inventors: Maria Missale; George Spector, both of 3615 Woolworth Bldg., 233 Broadway, New York, N.Y. 10007

[21] Appl. No.: 704,341

[22] Filed: Jul. 12, 1976

[51] Int. Cl.[2] ..... B67D 5/06

[52] U.S. Cl. ..... 222/192; 40/412; 40/426

[58] Field of Search ..... 222/113, 20.5, 333, 222/78, 192; 40/106.21, 106.23, 106.25, 412.426, 39, 406–408; 46/41, 42, 238–240; 239/16–18, 20, 22–24

[56] References Cited

U.S. PATENT DOCUMENTS

| | | | |
|---|---|---|---|
| 1,312,632 | 8/1919 | Huerta | 46/240 |
| 2,544,594 | 3/1951 | Goldfarb | 46/41 |
| 2,745,641 | 5/1956 | Jacobs | 239/24 |
| 2,828,950 | 4/1958 | Stilwell | 40/39 |

*Primary Examiner*—Robert J. Spar
*Assistant Examiner*—H. Grant Skaggs

[57] ABSTRACT

This invention is a toy soda jet for use by children and which is structurally generally similar to a commercial beverage dispenser fountain such as is placed upon a counter of a store; the present invention including a small electric operated motor having a magnet attached to the motor shaft, a transparent bowl on top having another magnet with a rotor which sends soda up through a tube, so the soda is seen streaming downward on the inner surface of the top of the bowl.

2 Claims, 3 Drawing Figures

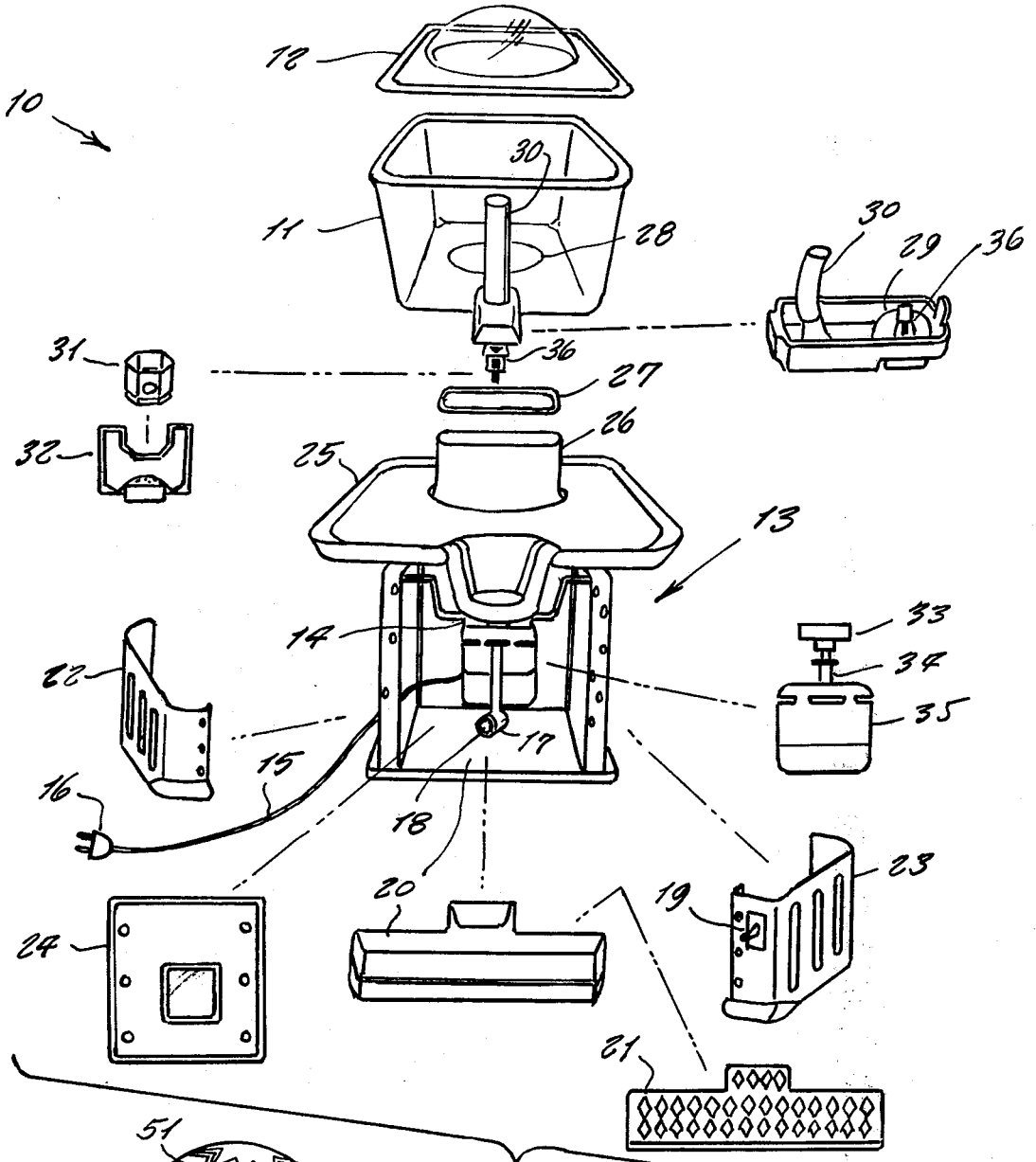
Fig. 1
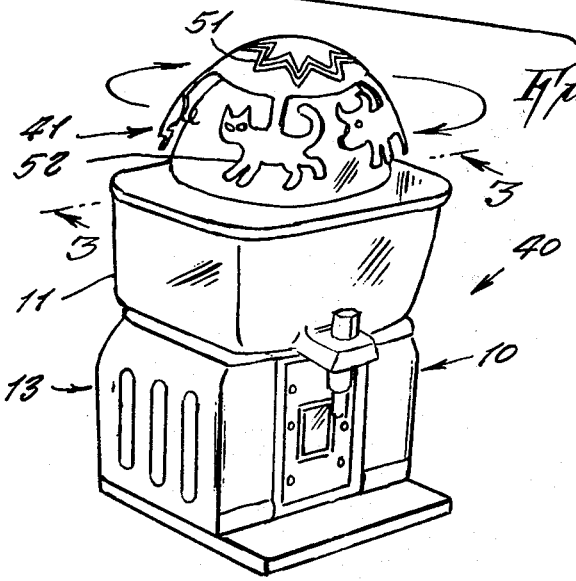
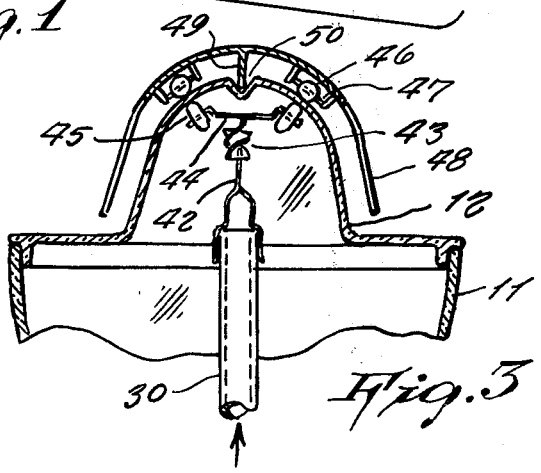
Fig. 3

TOY SODA JET DISPENSER WITH MOVING DISPLAY

This invention relates generally to beverage dispensing fountains.

A principal object of the present invention is to provide a soda jet for use as a toy by children, and which really dispenses soda.

Another object is to provide a toy soda dispenser for children which includes a clear glass bowl on top, and wherein the soda is seen to flow against the inner surface of the bowl top so to make an attractive display that appeals visually to the children.

Another object is to a toy soda jet that gives children many hours of enjoyment, and which is ideal for use at children's parties because the device can hold up to ½ gallon of soda.

Other objects are to provide a Toy Soda Dispenser which is simple in design, inexpensive to manufacture, rugged in construction, easy to use and efficient in operation.

These and other objects will be readily evident upon a study of the following specification and the accompanying drawing wherein:

FIG. 1 is an exploded perspective view of the invention.

FIG. 2 is a perspective view of a modified design of the invention shown assembled.

FIG. 3 is a cross section on line 3—3 of FIG. 2 and showing a beverage driven mechanism that causes a carousel of animal figures to rotate about the top of the device; the upwardly jetted beverage causing a blade to rotate which carries magnet rollers to attract steel rollers upon the outside of the dome to follow and which carry the animal carousel.

Referring now to the drawing in detail, and more particularly to FIG. 1 thereof at the present time, the reference numeral 10 represents a Toy Soda Dispenser according to the present invention wherein the same comprises an assembly that includes a transparent glass cover 12 on top thereof, and a transparent bowl 11 resting upon a base 13 that forms a housing around an electric motor-driven pump 14. An extension cord 15 therefrom is fitted with a male plug 16 for insertion into a female socket of a household electric outlet to provide electric power. Illumination is provided by a socket 17 with lamp 18. A manually controlled switch 19 is provided to actuated the electrically operated components. The base includes a bottom tray 20, an aluminum cover 21, opposite side covers 22 and 23, one of which supports the switch 19, and a front cover 24. On a top of the base, there is a chassis 25, a dome 26 fitted with a gasket 27 that seals liquid-tight the edge of a bottom opening 28 in the bowl. The mechanically operative structure includes an impeller pump assembly 29 and a tube 30 which carries the pumped soda upwardly against the underside of the cover so to then flow downward visably therefrom. A weight 31 and a lift 32 are located at a front of the device. A magnet 33 is mounted on a motor shaft 34 of the pump motor 35. In the bowl on top is another magnet 36 forming part of pump assembly 29 having a rotor that pumps the soda up through the tube, which is a principal feature of the invention. Weight 31 serves to retain lift 32 in a position closing the dispensing spout seen at the front of the bowl 11 of FIG. 2. To dispense soda, etc from the bowl a conventional manually operated member causes upward movement of 32 thus allowing soda to flow through the said spout.

In operative use, closure of switch 19, causes upward jetting of soda through tube 30 against the inside of cover 12 resulting in an attractive display.

A dispensing spout for soda in bowl 11 is seen in FIG. 2 at the front side of said bowl. Soda is dispensed through said spout into paper cups, glasses, etc in a conventional and well known manner.

In FIGS. 2 and 3, a modified design of Toy Soda Jet 40 includes the above described Toy Soda Jet 10 and additionally incorporates an externally visual rotatable display 41 that is comprised of a wire prong 42 mounted on the upper end of the tube 30, the upper end of the prong supporting a freely rotatable spiral shaped fin 43 to which is secured a cross arm 44 supporting freely rotatable wheels 45 at each end for bearing against the underside of the glass bowl cover 12. The wheels 45 are each made of permanent magnets so to cause magnetic rollers 46 externally mounted on the cover 12 to follow the rotational movement of the internal wheels 45. The rollers 46 rotate freely about pins 47 held on an underside of a plastic, hemi-spherical shaped canopy 48 externally mounted and balanced on top of the cover 12 by a downward extending central pin 49 seated in a small depression 50 formed on top of the cover 12. The outer side of the canopy has attractive designs 51 painted thereupon, and a fringe of the canopy is contoured in the shape of attractive characters such as friendly animals 52, etc.

As the upwardly pumped soda from tube 30 strikes the fin 43 and then is directed to flow down the inner surface of the cover and bowl, the canopy rotates to form a pleasing carousel.

While various changes may be made in the detail construction, it is understood that such changes will be within the spirit and scope of the present invention, as is defined by the appended claims.

What is claimed is:

1. A soda dispenser and movable display comprising a transparent bowl for soda having a dispensing spout, including a base supporting said bowl, including a transparent cover for said bowl, said base comprising a housing enclosing an electric motor in combination with an impeller pump assembly having a vertical tube extending into said bowl, said pump being magnetically driven by said motor including an electric extension for providing electric power to said motor in further combination with a rotatable display externally mounted on said cover, in combination with rotatable member mounted on said tube reacting to the force of a soda jet from said tube to cause the rotary movement of said member, wherein said member and display include coacting magnetic means whereby rotary movement of said member causes rotary movement of said display.

2. The combination of claim 1, wherein said display comprises a rotor having attractive characters rotatably mounted externally on said cover, wherein said member includes a spiral fin rotatably mounted axially on said tube for rotating said magnetic means.

* * * * *